US006752726B2

(12) United States Patent
Burrows

(10) Patent No.: US 6,752,726 B2
(45) Date of Patent: Jun. 22, 2004

(54) SLOTTED HOSEL FOR A GOLF CLUB

(75) Inventor: Bruce D. Burrows, Santa Clarita, CA (US)

(73) Assignee: Burrows Golf, LLC, Valencia, CA (US)

( * ) Notice: Subject to any disclaimer, the term of this patent is extended or adjusted under 35 U.S.C. 154(b) by 0 days.

(21) Appl. No.: 10/387,089

(22) Filed: Mar. 11, 2003

(65) Prior Publication Data

US 2003/0176235 A1 Sep. 18, 2003

Related U.S. Application Data

(60) Provisional application No. 60/365,216, filed on Mar. 18, 2002.

(51) Int. Cl.[7] ..... A63B 53/04
(52) U.S. Cl. ..... 473/309; 473/349
(58) Field of Search ..... 473/309, 310, 473/303, 324, 332, 327

(56) References Cited

U.S. PATENT DOCUMENTS

| | | | | |
|---|---|---|---|---|
| 1,266,529 A | | 5/1918 | Mattern | |
| 1,695,806 A | | 12/1928 | Heller | |
| 1,850,843 A | | 3/1932 | Lagerblade | |
| 1,892,482 A | * | 12/1932 | Cash, Jr. | 473/305 |
| 3,614,101 A | | 10/1971 | Hunter | |
| 5,324,033 A | | 6/1994 | Fenton, Jr. | |
| 5,335,909 A | | 8/1994 | Green, Jr. | |
| 5,452,890 A | | 9/1995 | Bingman | |
| 5,624,330 A | * | 4/1997 | Tsuchida | 473/308 |
| 5,647,807 A | | 7/1997 | Nagamoto | |
| 5,855,526 A | | 1/1999 | Honma | |
| 5,888,149 A | | 3/1999 | Allen | |
| 5,938,541 A | | 8/1999 | Allen et al. | |
| 6,033,318 A | | 3/2000 | Drajan, Jr. et al. | |
| 6,146,286 A | | 11/2000 | Masuda | |

* cited by examiner

*Primary Examiner*—Stephen Blau
(74) *Attorney, Agent, or Firm*—Kelly Lowry & Kelley, LLP

(57) ABSTRACT

A slotted hosel and related attachment system and method are provided for securely affixing a golf club head to the end of a golf club shaft. The hosel is formed to extend generally upwardly from a heel end of the club head and has a generally cylindrical shape defining an upwardly open hosel bore. At least one and preferably multiple laterally open slots are formed in the hosel to reduce the weight thereof. A relatively thin-walled liner sleeve is slide-fitted into the hosel bore and thereafter expanded to form dimples therein protruding outwardly into secure mechanical interlocking relation with the hosel. The end of the club shaft is thereafter slide-fitted into the liner sleeve and securely affixed therein by epoxy or the like.

28 Claims, 4 Drawing Sheets

FIG. 3
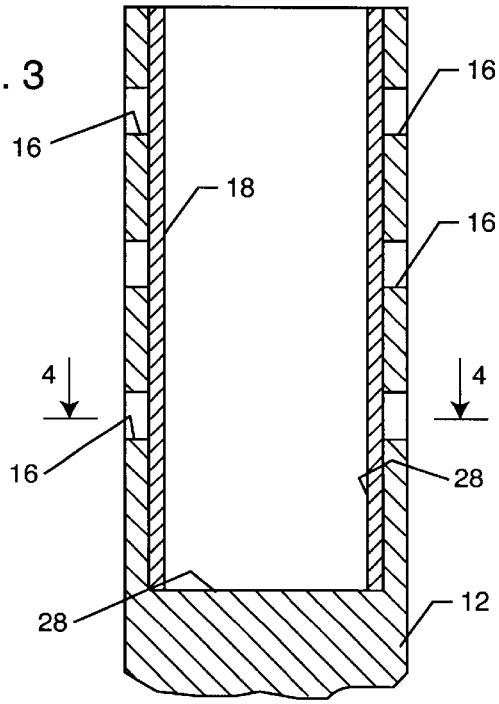
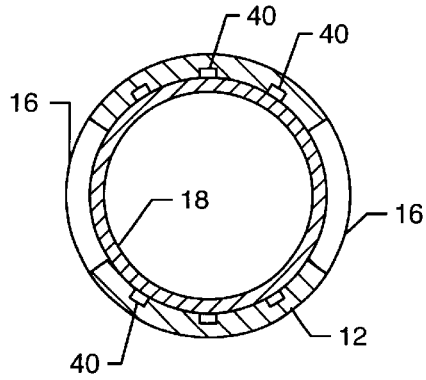
FIG. 4
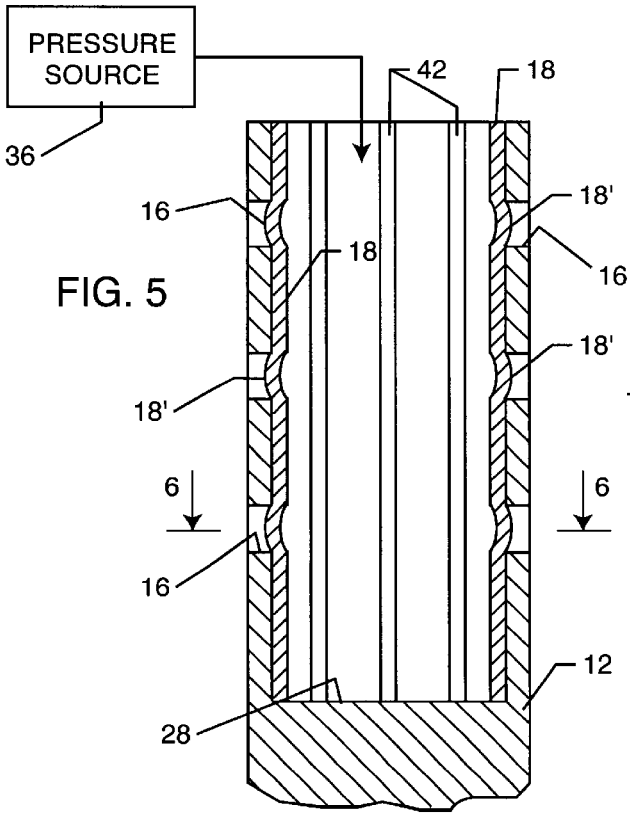
FIG. 5
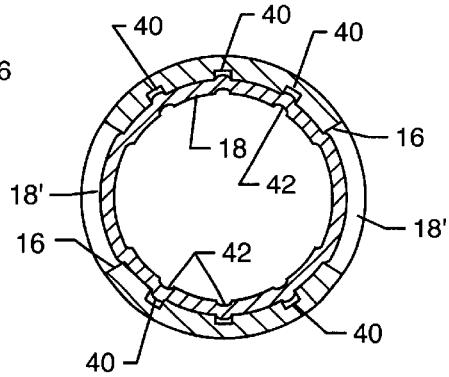
FIG. 6

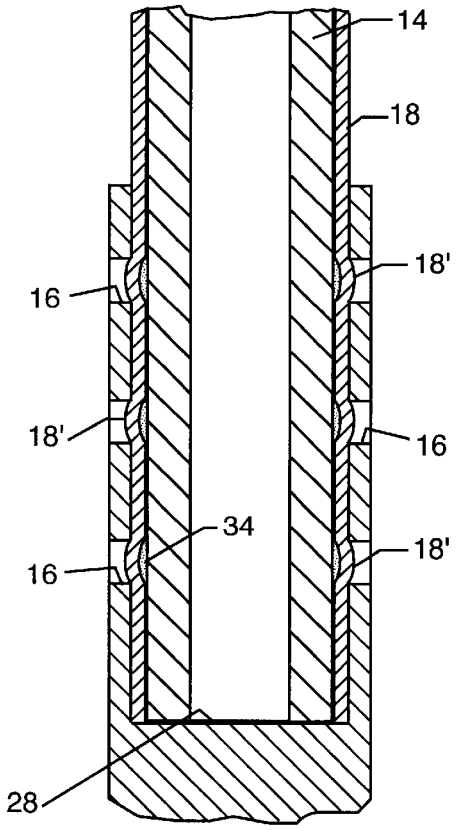
FIG. 8
FIG. 9
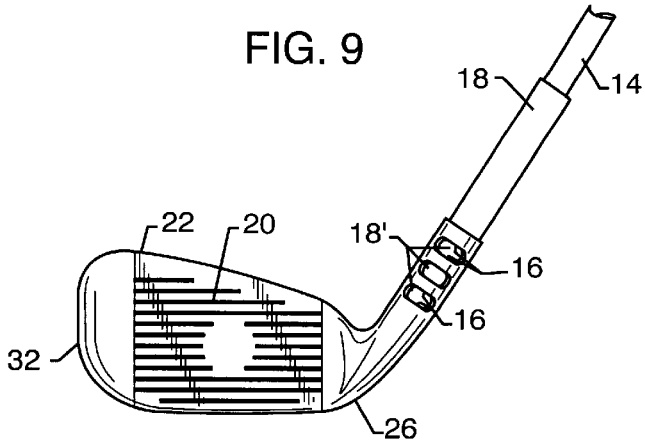
FIG. 10
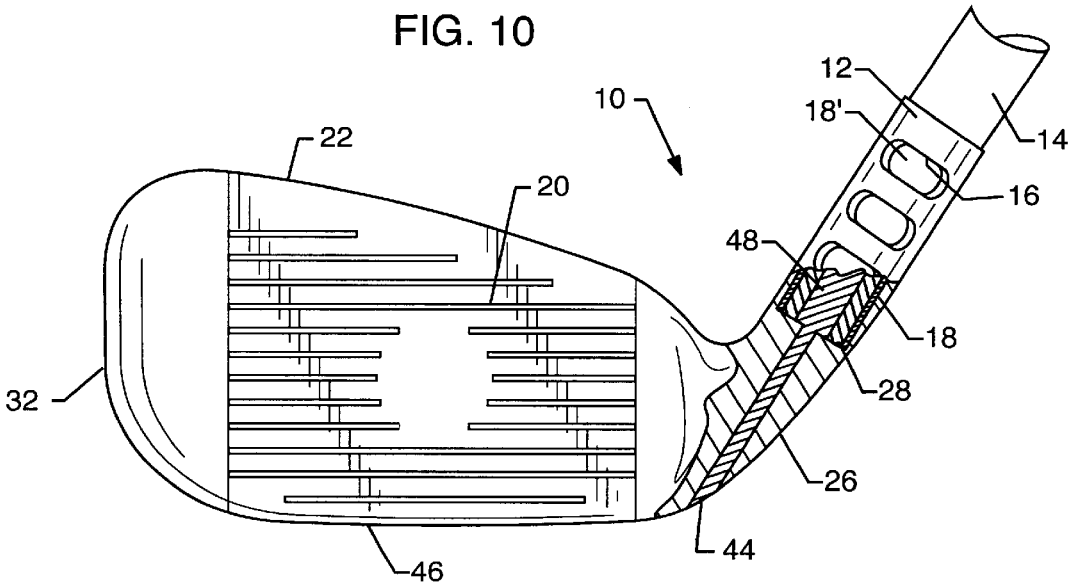

SLOTTED HOSEL FOR A GOLF CLUB

This application claims the benefit of U.S. Provisional Application No. 60/365,216, filed Mar. 18, 2002.

BACKGROUND OF THE INVENTION

This invention relates generally to improvements in golf clubs, particularly with respect to improved club head attachment to the end of a golf club shaft and related improvements in club head weight distribution. More specifically, this invention relates to a slotted hosel for a golf club head wherein hosel weight at the heel end of the club head is reduced by formation of one or more slots in the hosel, in combination with improved apparatus and method for securely affixing the end of a club shaft to the slotted hosel.

Golf clubs are well known in the art and generally comprise an iron-style or so-called wood-style club head attached by means of an open-ended tubular hosel to the lower end of an elongated club shaft. The hosel comprises an upwardly open socket structure extending generally upwardly at an appropriate angle from the heel end of the club head for slide-fit reception of the lower end of the club shaft and related secure interconnection therewith as by means of a suitable epoxy adhesive or the like. In recent years, both iron-type and so-called metal wood-type club heads have been formed from metal such as stainless steel, titanium or titanium alloy, with considerable design effort directed to controlled and balanced distribution of club head weight to provide an optimized center of gravity or sweet spot for impact with a golf ball. However, the hosel presents a substantial off-center mass located at the heel end thereof where it complicates attempts to optimize balanced weighting of the club head.

In the past, modified hosel designs have envisioned the formation of external grooves in the hosel to reduce the hosel weight and thereby permit redistribution of the club head weight in a more advantageous manner. In particular, the weight removed from the grooved hosel can be redistributed in a controlled manner about the perimeter of the club head and/or ball impact face thereof, without increasing the overall club head weight, so that the club head center of gravity (i.e., the sweet spot) can be lowered and shifted toward a more centered position between the heel and toe of the club head. See, for example, U.S. Pat. Nos. 5,324,033 and 5,647,807. However, to avoid undesired weakening of the hosel/shaft attachment interface, such external hosel grooves have been relatively shallow and specifically have not been provided in the form of open slots extending radially through the hosel structure which would reduce the epoxy attachment area between the hosel and shaft. Unfortunately, this approach results in relatively minimal hosel weight reduction and a correspondingly minimal club head weight redistribution and related improvements in ball impact performance.

The present invention is specifically directed to the provision of a hosel structure of significantly reduced mass, by the formation of at least one and preferably multiple radially open slots formed in the hosel, to substantially reduce the hosel weight and thereby accommodate a significant redistribution of club head weight for improved, substantially optimized and consistent ball impact performance. The reduced mass hosel structure is provided without sacrificing the structural integrity or strength of the attachment interface with the end of the club shaft.

SUMMARY OF THE INVENTION

In accordance with the invention, a slotted hosel and related attachment system and method are provided for securely affixing a golf club head to the end of a golf club shaft. The hosel formed generally at a heel end of the club head incorporates at least one and preferably multiple laterally or radially open slots to significantly reduce the hosel weight or mass, and thereby permit redistibution of such weight or mass to the club head in a manner providing overall club head balance and weighting, and correspondingly improved ball impact performance.

The hosel is normally formed integral with a typically cast club head of the iron or so-called metal wood type to extend generally upwardly at an appropriate angle from the heel end of the golf club head. The hosel is suitably cast or machined to define an open-ended and generally cylindrical, upwardly open hosel bore. At least one and preferably multiple slots are formed through the hosel wall in a desired pattern to substantially reduce the weight of the hosel. A relatively thin-walled and preferably lightweight liner sleeve of titanium or the like is slide-fitted into the hosel bore and thereafter expanded as by application of hydraulic or other fluid pressure or mechanical means to create outwardly deformed dimples protruding partially into the hosel slots. These dimples in the liner sleeve provide a secure mechanical interlock between the hosel and liner sleeve. The end of the club shaft is thereafter slide-fitted into the liner sleeve and securely affixed thereto by means of a suitable epoxy adhesive or the like.

In a modified form of the invention, the mechanical interlock between the hosel and liner sleeve may be enhanced by additionally forming longitudinally elongated grooves within the hosel bore. In this embodiment, expansion of the liner sleeve to form the dimples is accompanied by additional liner sleeve expansion to form longitudinally elongated ridges interlocked with the hosel bore grooves. Further hosel/liner sleeve interlock can be obtained by means of a suitable epoxy adhesive or the like.

In a further variation of the invention, the axial length of the liner sleeve can be chosen so that an upper segment of the liner sleeve is extended and exposed above an upper margin of the hosel, when the liner sleeve is seated within the hosel bore. The exposed upper segment of the liner sleeve provides support for the club shaft at the hosel attachment site, and is particularly beneficial for closely controlling the flex characteristics of a nonmetal shaft, such as a club shaft formed from graphite materials or the like. In another variation, a small pilot port may be formed in the club head to extend generally coaxially from a lower or base end of the hosel bore to the lower margin of the club head. In this version, the pilot port accommodates partially filling of the lower end of a typically hollow tubular club shaft in the region of the hosel attachment interface with a resilient elastomer composition.

Other features and advantages of the invention will become more apparent from the following detailed description, taken in conjunction with the accompanying drawings which illustrate, by way of the example, the principles of the invention.

BRIEF DESCRIPTION OF THE DRAWINGS

FIG. 3 is a fragmented sectional view illustrating manufacture of the slotted hosel, depicting reception of a liner sleeve therein;

FIG. 4 is a sectional view taken generally on the line 4—4 of FIG. 3;

FIG. 5 is a fragmented sectional view similar to FIG. 3, but showing deformation of the liner sleeve into secure locked relation with the slotted hosel;

FIG. 6 is a sectional view taken generally on the line 6—6 of FIG. 5;

FIG. 8 is a fragmented sectional view similar to FIG. 7, but illustrating one alternative preferred form of the invention;

FIG. 9 is a fragmented front elevation view of an iron-type golf club in accordance with the embodiment of FIG. 8; and FIG. 10 is a fragmented front elevation view similar to FIG. 1, but showing a further alternative preferred form of the invention.

DETAILED DESCRIPTION OF THE PREFERRED EMBODIMENTS

Figure 1:
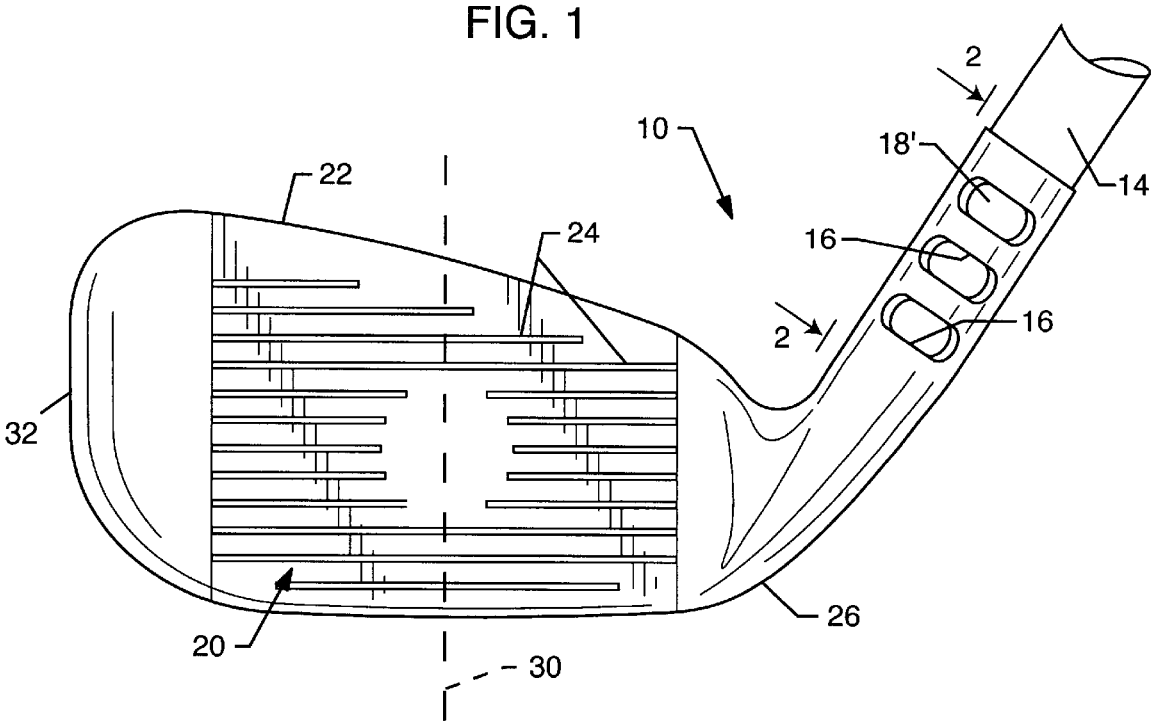
FIG. 1 is a fragmented front elevation view showing an iron-type golf club head having a slotted hosel in accordance with the novel features of the invention.

As shown in the exemplary drawings, a golf club head referred to generally in FIG. 1 by the reference numeral 10 incorporates an angularly upwardly extending hosel 12 adapted for secure attachment to the lower end of a golf club shaft 14. As shown, the hosel 12 has at least one and preferably a plurality of radially or laterally open slots 16 formed therein to substantially reduce the hosel weight or mass, and thereby permit the hosel weight reduction to be redistributed over the club head 10 in a manner to improve ball impact performance. A lightweight liner sleeve 18 (FIGS. 3–7) is slide-fitted into the slotted hosel 12 and expanded to create dimples 18' (FIGS. 1–2 and 5–7) which protrude partially into and securely interlock with the hosel slots 16. The lower end of the club shaft 14 is then slide-fitted into the liner sleeve 18 and securely attached thereto as by means of an epoxy adhesive or the like.

FIG. 1 illustrates the slotted hosel concept of the present invention in connection with an iron-style or iron-type golf club head 10, although it will be recognized and understood that the invention may be employed with a wood-style or wood-type club head particularly such as a so-called metal wood club head. In either golf club head configuration, the club head is commonly manufactured by metal casting from a suitable metal material such as titanium or titanium alloy, stainless steel, or the like to include a generally forwardly presented club face 20 for striking a golf ball. The club face 20 is oriented in a generally upright plane, with an upper margin 22 tilted rearwardly at a selected angle according to the specific club, i.e., driver, three-wood, 5-iron, 9-iron, etc. In addition, the club face 20 traditionally includes a groove pattern 24 formed therein, such as the illustrative array of generally horizontally extending parallel grooves. The hosel 12 is normally cast as an integral portion of the club head 10 to extend upwardly and angularly from a heel end 26 of the club head for attachment to the lower end of the club shaft 14. In this regard, the hosel 12 has a generally open-ended tubular geometry which can be cast or machined to define an upwardly open hosel bore 28 (FIG. 3) for receiving the end of the club shaft 14.

In accordance with the invention, the open slots 16 which can be cast or machined into the wall of the hosel 12 represent a substantial reduction in the hosel weight or mass, wherein this weight reduction occurs generally at the heel end 26 of the club head 10. In other words, the hosel weight reduction effectively removes weight from the club head at a location that is off-center relative to a vertical axis 30 (FIG. 1) extending through the club head 10 and associated ball impact faceplate 20. The weight removed from the hosel 12 can be redistributed throughout the club head 10, such as by additional perimeter weighting surrounding the faceplate 20 typically at the rear side thereof (not shown), resulting in a lowered club head center of gravity which is also shifted toward a substantially centered position between the heel end 26 and a toe end 32 of the club head. The thus-shifted club head center of gravity corresponds to the so-called sweet spot for optimal striking of a golf ball, wherein the redistribution of the reduced hosel weight throughout the club head results in improved overall ball striking performance. Importantly, such improved performance is achieved without increasing the weight of the overall club head, and further without sacrificing the structural integrity of the club head/shaft attachment interface.

Figure 2:
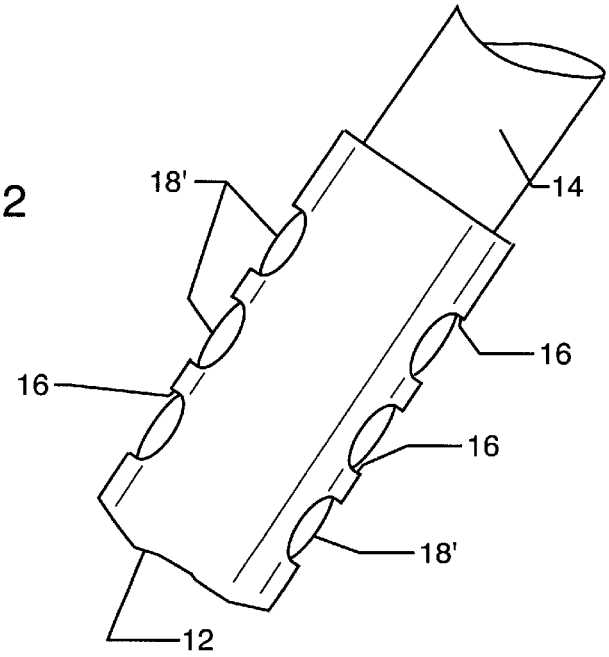
FIG. 2 is an enlarged fragmented view of the slotted hosel, taken generally on the line 2—2 of FIG. 1.

FIGS. 1–3 show the slotted hosel 12 in one preferred configuration to include a trio of radially or laterally open slots 16 formed in a front side and also in a rear side of the hosel wall in vertically spaced relation. This total of six slots 16 represents a substantial reduction in the weight or mass of the otherwise unslotted hosel 12. It will be recognized and understood that the size, shape and number of the hosel slots 16 can be variably selected, as desired.

During assembly of the club head 10 and the associated shaft 14, the relatively thin and preferably lightweight liner sleeve 18 is slidably fitted with relatively close clearance into the upwardly open hosel bore 28, as shown in FIGS. 3–4, to cover and close the hosel slots 16. In the preferred form, this liner sleeve 18 is constructed from a material having a mass per unit volume that is equal to and preferably less than the club head material, such as lightweight titanium or titanium alloy or the like. In addition, the liner sleeve 18 is relatively thin-walled in comparison to the hosel wall. In one example of the invention, the liner sleeve 18 is constructed from a titanium alloy with a wall thickness of about 10–20 mils, whereas the thickness of the hosel wall is about 75 mils. The liner sleeve 18 has a length to seat firmly into a lower or base end of the hosel bore 28, to position an upper end of the liner sleeve 18 at least coextensive with an upper margin of the hosel 12. In one alternative embodiment of the invention, as viewed in FIGS. 8 and 9, the upper end of the liner sleeve 18 may protrude a selected distance above the upper margin of the hosel 12.

With the liner sleeve 18 firmly seated within the hosel bore 28, the interior of the liner sleeve is subjected to elevated hydraulic or other fluid pressure by coupling (as viewed in FIG. 5) to a suitable pressure source 36. The pressure source is sufficient to radially expand the liner sleeve 18 in the regions of the hosel slots 16, without deforming the hosel 12, to create the radially outwardly protruding dimples 18' which positively and securely lock the liner sleeve within the hosel 12. In one example of the invention, elevated hydraulic pressure is applied to create the outwardly protruding dimples 18', which bulge outwardly about 10–15 mils. Further enhanced mechanical interlock between these components may be achieved by additionally forming elongated shallow grooves 40 (FIG. 6) within the hosel bore 28, so that the pressure-caused expansion of the liner sleeve 18 additionally deforms the liner sleeve to create small radially outwardly protruding ridges 42 extending into and interlocking with these hosel grooves 40. Further attachment between the liner sleeve 18 and hosel 12, if desired, may be obtained by applying an epoxy adhesive or the like to the interior of the hosel bore 28 prior to slide-fit placement of the liner sleeve 18 therein.

Figure 7:
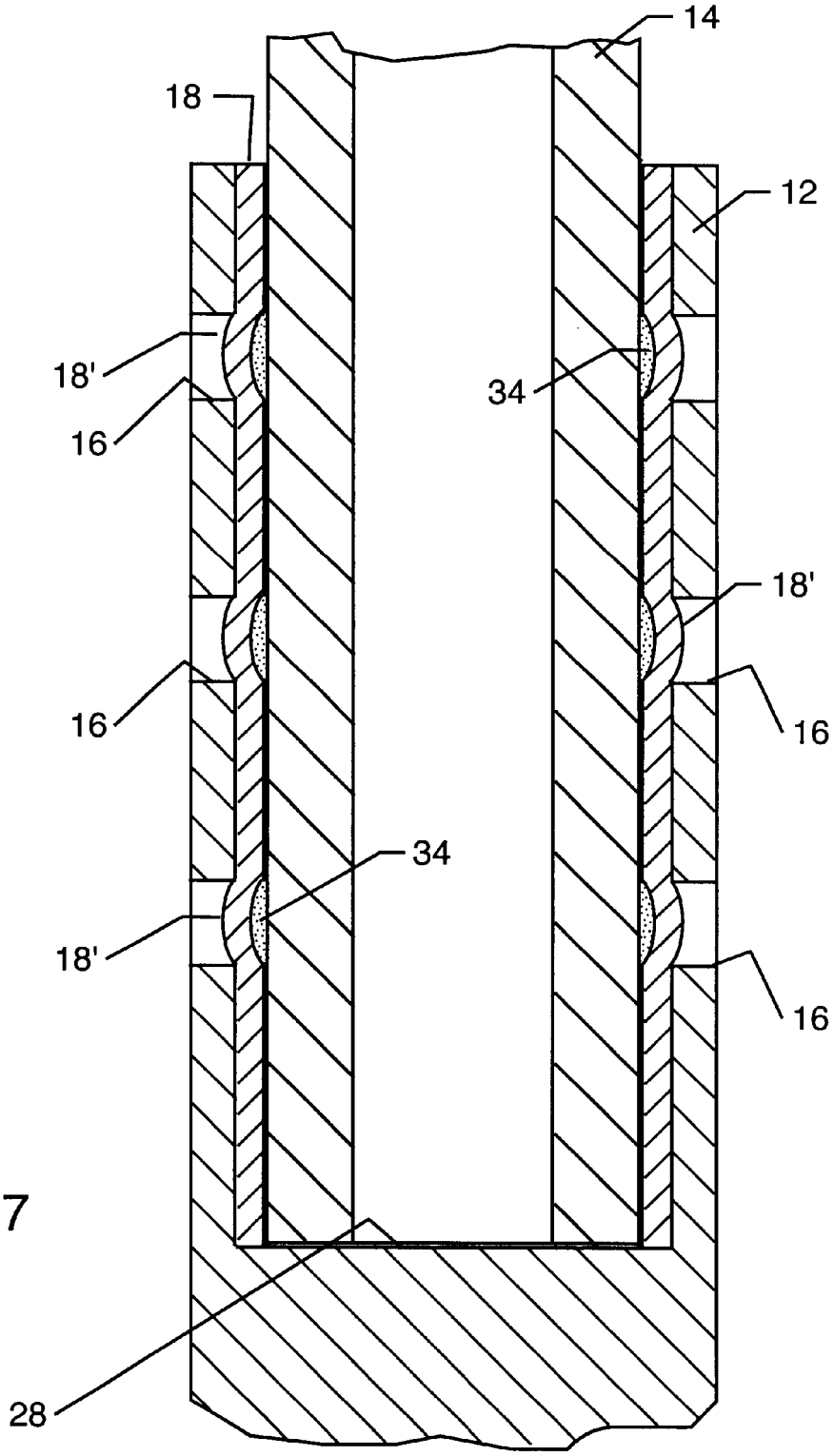
FIG. 7 is a fragmented sectional view similar to FIG. 5, and depicting mounting of a club shaft end into the deformed liner sleeve.

With the liner sleeve 18 securely attached within the hosel 12, the lower end of the club shaft 14 can be slidably received into the hollow interior of the liner sleeve, as shown in FIG. 7. The liner sleeve 18 presents a full cylindrical and uninterrupted internal surface area for secure shaft attachment therein, as by means of an epoxy adhesive 34 or the like. In this regard, the upper end of the liner sleeve 18 may terminate substantially at the upper margin of the hosel 12 when a metal shaft is used (FIG. 7). Alternately, when a lightweight and highly flexible nonmetal shaft is used, such as graphite or carbon fiber shaft material, the upper margin of the liner sleeve 18 may protrude a selected distance above the upper margin of the hosel (FIGS. 8 and 9), typically a distance on the order of about 6 inches, to reinforce and strengthen the lower end of the shaft, and further to controllably regulate shaft flexibility or whip at that location. This upwardly extended sleeve configuration is particularly effective with thin-walled and highly flexible club shaft constructions, by substantially minimizing or preventing shaft twist to a significantly out-of-round geometry during an off-center impact with a golf ball. Instead, the upwardly extended sleeve 18 reinforces the shaft 14 to stabilize and maintain the round shaft cross section during an off-center impact to result in improved and consistent control of ball flight direction.

FIG. 10 illustrates a further alternative embodiment of the invention, wherein a pilot port 44 is formed in the heel end 26 of the club head 10, to extend from the base of the hosel bore 28 to a lower margin 46 of the club head. This pilot port 44 forms an access port to the interior of the liner sleeve 18 and the hollow interior of the club shaft 14 installed therein, so that a portion of the club shaft interior can be filled with a selected elastomer 48 chosen for vibration-damping characteristics. The elastomer 48 can be injected through the pilot port 44 to fill the shaft interior in the region of the hosel 12 or upwardly beyond the hosel, as desired.

A variety of further modifications and improvements in and to the slotted hosel and related club shaft attachment method of the present invention will be apparent to those persons skilled in the art. For example, while pneumatic means are disclosed for forming the outwardly protruding dimples 18' within the open slots 16, persons skilled in the art will recognize and understand that alternative mechanical dimple forming means and the like may be used. Accordingly, no limitation on the invention is intended by way of the foregoing description and accompanying drawings, except as set forth in the appended claims.

What is claimed is:

1. A golf club, comprising:

a club head having a heel end and a toe end and defining a club face for impact engagement with a golf ball, said club head further including a hosel extending generally upwardly from said heel end thereof and defining a generally upwardly open hosel bore, said hosel having at least one laterally open hosel slot formed therein to extend from said bore completely through to an outer surface of said hosel;

a liner sleeve fitted into said hosel bore and including at least one dimple protruding outwardly at least partially into said at least one hosel slot for mechanically locking said liner sleeve within said hosel slot; and a club shaft having a lower end seated within and connected to said liner sleeve.

2. The golf club of claim 1 wherein said club head comprises an iron-type club head.

3. The golf club of claim 1 wherein said club head comprises a wood-type club head.

4. The golf club of claim 1 wherein said at least one laterally open hosel slot comprises a plurality of laterally open hosel slots, and further wherein said at least one liner sleeve dimple comprises a plurality of dimples protruding outwardly and received respectively at least partially into said plurality of hosel slots.

5. The golf club of claim 1 further including adhesive means connecting said liner sleeve to said hosel.

6. The golf club of claim 1 further including adhesive means for connecting said club shaft lower end to said liner sleeve.

7. The golf club of claim 1 wherein said liner sleeve defines an upper margin extending a selected distance beyond and above an upper margin of said hosel.

8. The golf club of claim 1 wherein said hosel further has at least one longitudinally extending internal groove formed therein, and further wherein said liner sleeve has at least one radially outwardly protruding ridge extending at least partially into said groove for mechanically locking said liner sleeve within said hosel slot.

9. The golf club of claim 8 wherein said at least one internal groove formed within said hosel comprises a plurality of longitudinally extending internal grooves, and further wherein said at least one radially outwardly protruding ridge on said liner sleeve comprises a plurality of radially outwardly protruding ridges for respective reception at least partially into said plurality of hosel grooves.

10. The golf club of claim 1 wherein said liner sleeve has a wall thickness less than said hosel.

11. The golf club of claim 1 wherein said liner sleeve is formed from a material having a mass per unit volume less than said hosel.

12. The golf club head of claim 1 said club shaft lower end is hollow, and further including a resilient elastomer within at least a portion of said club shaft lower end.

13. A golf club, comprising:

a club head having a heel end and a toe end and defining a club face for impact engagement with a golf ball, said club head further including a hosel extending generally upwardly from said heel end thereof and defining a generally upwardly open hosel bore, said hosel having a plurality of laterally open hosel slots formed therein each to extend from said bore completely through to an outer surface of said hosel;

a liner sleeve fitted into said hosel bore and including a plurality of dimples protruding outwardly and extending respectively at least partially into said hosel slots for mechanically locking said liner sleeve within said hosel slot; and a club shaft having a lower end seated within and connected to said liner sleeve.

14. The golf club of claim 13 further including adhesive means for connecting said club shaft lower end to said liner sleeve.

15. The golf club of claim 13 wherein said liner sleeve defines an upper margin extending a selected distance beyond and above an upper margin of said hosel.

16. The golf club of claim 13 wherein said hosel further has a plurality of longitudinally extending internal grooves formed therein, and further wherein said liner sleeve has a plurality of radially outwardly protruding ridge extending respectively at least partially into said grooves for mechanically locking said liner sleeve within said hosel slot.

17. The golf club of claim 13 wherein said liner sleeve has a wall thickness less than said hosel.

18. The golf club of claim 13 wherein said liner sleeve is formed from a material having a mass per unit volume less than said hosel.

19. The golf club head of claim 13 said club shaft lower end is hollow, and further including a resilient elastomer within at least a portion of said club shaft lower end.

20. A method of attaching a lower end of a golf club shaft to an upwardly open hosel of a golf club head, said hosel defining an upwardly open hosel bore, said method comprising the steps of:

formed at least one laterally open slot in the hosel have been added;

inserting a liner sleeve into the hosel bore;

expanding the liner sleeve to form at least one dimple protruding outwardly for at least partial reception into the at least one hosel slot to mechanically interconnect the liner sleeve with the hosel; and seating and connecting a lower end of the club shaft within the liner sleeve.

21. The method of claim 20 wherein said step of forming at least one hosel slot comprises forming a plurality of radially open hosel slots in the hosel, and further wherein said step of forming at least one dimple comprises forming a plurality of dimples for respective reception at least partially into the hosel slots.

22. The method of claim 20 further including the step of connecting the liner sleeve to the hosel with adhesive means.

23. The method of claim 20 wherein said step of seating and connecting the lower end of the club shaft within the liner sleeve comprises adhesively connecting the club shaft lower end within the liner sleeve.

24. The method of claim 20 wherein said liner sleeve expanding step comprises connecting a fluid under pressure to the liner sleeve.

25. The method of claim 20 wherein said liner sleeve expanding step comprises mechanically expanding the liner sleeve.

26. The method of claim 20 further including the step of forming at least one longitudinally extending internal groove within the hosel, said expanding step further expanding the liner sleeve to form at least one radially outwardly protruding ridge extending at least partially into said groove for mechanically locking said liner sleeve within said hosel slot.

27. The method of claim 20 wherein the club shaft lower end is hollow, and further including the step of at least partially filling the club shaft lower end with a resilient elastomer.

28. The method of claim 27 wherein said step of at least partially filling the club shaft lower end comprises the step of introducing the resilient elastomer through a pilot port formed in the club head.

* * * * *